US012349813B2

(12) United States Patent
Liang

(10) Patent No.: US 12,349,813 B2
(45) Date of Patent: Jul. 8, 2025

(54) PLAYPEN WITH AUTOMATIC LOCKING FUNCTION

(71) Applicant: GUANGZHOU PRODIGY DAILY-PRODUCTION CO., LTD, Guangdong (CN)

(72) Inventor: Zhanpeng Liang, Guangdong (CN)

(73) Assignee: GUANGZHOU PRODIGY DAILY-PRODUCTION CO., LTD, Guangzhou (CN)

( * ) Notice: Subject to any disclaimer, the term of this patent is extended or adjusted under 35 U.S.C. 154(b) by 217 days.

(21) Appl. No.: 18/231,789

(22) Filed: Aug. 9, 2023

(65) Prior Publication Data

US 2025/0031872 A1 Jan. 30, 2025

(30) Foreign Application Priority Data

Jul. 24, 2023 (CN) ..... 202310913720.6

(51) Int. Cl.
*A47D 13/06* (2006.01)

(52) U.S. Cl.
CPC ..... *A47D 13/06* (2013.01)

(58) Field of Classification Search
CPC ..... A47D 13/00; A47D 13/06; A47D 13/063; A47D 15/00; A47D 15/008
See application file for complete search history.

(56) References Cited

U.S. PATENT DOCUMENTS 9,756,964 B2 * 9/2017 Yang ..... A47D 13/063
2015/0272343 A1 * 10/2015 Hung ..... A47D 13/061 5/99.1

* cited by examiner

*Primary Examiner* — Fredrick C Conley

(57) ABSTRACT

The present disclosure provides a playpen with an automatic locking function, comprising a top cover; an inner sliding rod, the inner sliding rod being mounted below the top cover and provided with a cylindrical receiving cavity, and first sliding grooves communicated with the cylindrical receiving cavity being formed in two sides of the inner sliding rod; a knob, the knob being mounted in the top cover and clamped with the top cover and the outer sliding rod, and the knob being able to move upwards or downwards and rotate with respect to the top cover to be located at a locking position or an unlocking position; and a link assembly, the link assembly being articulated with the top cover and the sliding seat. The playpen can be locked automatically when unfolded, and can be freely switched to a locked state or unlocked state by users.

10 Claims, 10 Drawing Sheets

PLAYPEN WITH AUTOMATIC LOCKING FUNCTION

CROSS REFERENCE TO RELATED APPLICATIONS

The present application claims the benefit of Chinese Patent Application No. 202310913720.6 filed on Jul. 24, 2023, the contents of which are incorporated herein by reference in their entirety.

BACKGROUND OF THE INVENTION

1. Technical Field

The invention belongs to the technical field of protective articles, and particularly relates to a playpen with an automatic locking function.

2. Description of Related Art

At present, most playpens are made of existing tent support frames, which cannot satisfy the use requirements of children's products. When applied to playpens, the tent support frames in the prior art have the following defects: first, the tent support frames cannot be locked automatically, and if children playing in the playpens exert an upward force on inner support rods, the support frames may be folded, causing injuries to children; second, even if such tent support frames can be locked automatically after being unfolded, these tent support frames cannot be folded until they are manually unlocked; in addition, the tent support frames can be automatically locked only when are unfolded, and cannot be switched to a locked state or an unlocked state freely by users in the unfolded state, making the tent support frames inconvenient and inflexible to use.

BRIEF SUMMARY OF THE INVENTION

The main objective of the invention is to provide a playpen with an automatic locking function, which can be locked automatically when unfolded, and can be freely switched to a locked state or unlocked state by users.

the invention provides a playpen with an automatic locking function, comprising:

A top cover;

An inner sliding rod, the inner sliding rod being mounted below the top cover and provided with a cylindrical receiving cavity, and first sliding grooves communicated with the cylindrical receiving cavity being formed in two sides of the inner sliding rod;

An outer sliding rod, the outer sliding rod being rotatably disposed around the inner sliding rod, and second sliding grooves being formed in two sides of the outer sliding rod and corresponding to the first sliding grooves in position;

A limiting rod, the limiting rod being disposed in the cylindrical receiving cavity, and two ends of the limiting rod stretching out along the first sliding grooves and the second sliding grooves and being able to slide in the first sliding grooves and the second sliding grooves;

A sliding seat, the sliding seat being slidably disposed around the outer sliding rod, and the two ends of the limiting rod being clamped with the sliding seat;

A knob, the knob being mounted in the top cover and clamped with the top cover and the outer sliding rod, and the knob being able to move upwards or downwards and rotate with respect to the top cover to be located at a locking position or an unlocking position; and A link assembly, the link assembly being articulated with the top cover and the sliding seat.

According to the playpen with an automatic locking function in this embodiment of the first aspect of the present disclosure, each second sliding groove comprises a vertical section and an oblique section, and an angle is formed between the vertical section and the oblique section, such that the limiting rod can slide along slopes in the oblique sections when moving upwards or downwards; and the oblique sections of the two second sliding rods are opposite in direction, such that the outer sliding rod can rotate in corresponding directions.

According to the playpen with an automatic locking function in this embodiment of the first aspect of the present disclosure, first limiting grooves are formed in two sides of the top cover, first protrusions are disposed in the middle of the first limiting grooves, each first protrusion comprises a first oblique side and a first steep side, and limiting protrusions matched with the first protrusions are disposed on two sides of the knob; when the limiting protrusions are located the first oblique sides, the knob is located at the unlocking position and is in a first state; and when the limiting protrusions are located on the steep sides, the knob is located at the locking position and is in a second state.

According to the playpen with an automatic locking function in this embodiment of the first aspect of the present disclosure, second limiting grooves are formed in two sides of a top end of the outer sliding rod, second protrusions are disposed in the middle of the second limiting grooves, each second protrusion comprises a second oblique side and a second steep side, and two limiting pillars matched with the second protrusions are disposed at the bottom of the knob; when the limiting pillars are located on the second oblique sides, the knob is movably connected to the outer sliding rod; and when the limiting pillars are located on the second steep sides, the knob is fixedly connected to the outer sliding rod.

According to the playpen with an automatic locking function in this embodiment of the first aspect of the present disclosure, recesses for receiving the second protrusions are formed in inner sides of the limiting pillars.

According to the playpen with an automatic locking function in this embodiment of the first aspect of the present disclosure, a first spring is disposed in the cylindrical receiving cavity, one end of the first spring abuts against the bottom of the cylindrical receiving cavity, and the other end of the first spring abuts against the limiting rod.

According to the playpen with an automatic locking function in this embodiment of the first aspect of the present disclosure, a mounting portion fixedly connected to the top cover is disposed at a top end of the inner sliding rod, a second spring is disposed between the knob and the mounting portion, and two ends of the second spring abut against the knob and the mounting portion respectively.

According to the playpen with an automatic locking function in this embodiment of the first aspect of the present disclosure, the link assembly comprises an upper support rod and a lower support rod, the upper support rod is articulated with the top cover through an upper support rod front connecting sleeve, and the lower support rod is articulated with the sliding seat through a lower support rod front connecting sleeve.

According to the playpen with an automatic locking function in this embodiment of the first aspect of the present disclosure, an upper support rod middle connecting sleeve is slidably connected to the middle of the upper support rod, an upper support rod rear connecting sleeve is disposed at a rear end of the upper support rod, a lower support rod rear connecting sleeve is disposed at an end, away from the sliding seat, of the lower support rod, and the upper support rod middle connecting sleeve is articulated with the lower support rod rear connecting sleeve.

According to the playpen with an automatic locking function in this embodiment of the first aspect of the present disclosure, the link assembly comprises a vertical rod, one end of the vertical rod is articulated with the upper support rod rear connecting sleeve through a vertical rod upper sleeve, a vertical rod lower sleeve is disposed at the other end of the vertical rod, and a support pad is disposed on the vertical rod lower sleeve.

One of the abovementioned technical solutions of the invention has at least one of the following advantages or beneficial effects:

According to the playpen with an automatic locking function, the knob is disposed on the top cover and is clamped with the top cover and the outer sliding rod respectively; when the playpen is unfolded, the limiting rod slides downwards along the first sliding grooves and the second sliding grooves to the bottom, and at this moment, the outer sliding rod drives the knob to rotate from the unlocking position of the top cover to the locking position of the top cover, such that the playpen is automatically locked in the unfolded state, which can effectively prevent accidents caused by sudden folding of the support frame; the rotary knob can move upwards or downwards and rotate with respect to the top cover, and when the playpen is in the unfolded state, the knob can be pressed downwards to rotate to the unlocking position from the locking position, such that the playpen can be freely switched to the locked state or the unlocked state, and the playpen in the unlocked state can be folded by users; and the playpen is simple in structure and convenient to use.

BRIEF DESCRIPTION OF THE SEVERAL VIEWS OF THE DRAWINGS

The invention will be further described below in conjunction with accompanying drawings and embodiments.

DETAILED DESCRIPTION OF THE INVENTION

Many different embodiments or examples are provided below to implement different solutions of the invention.

Figure 1:
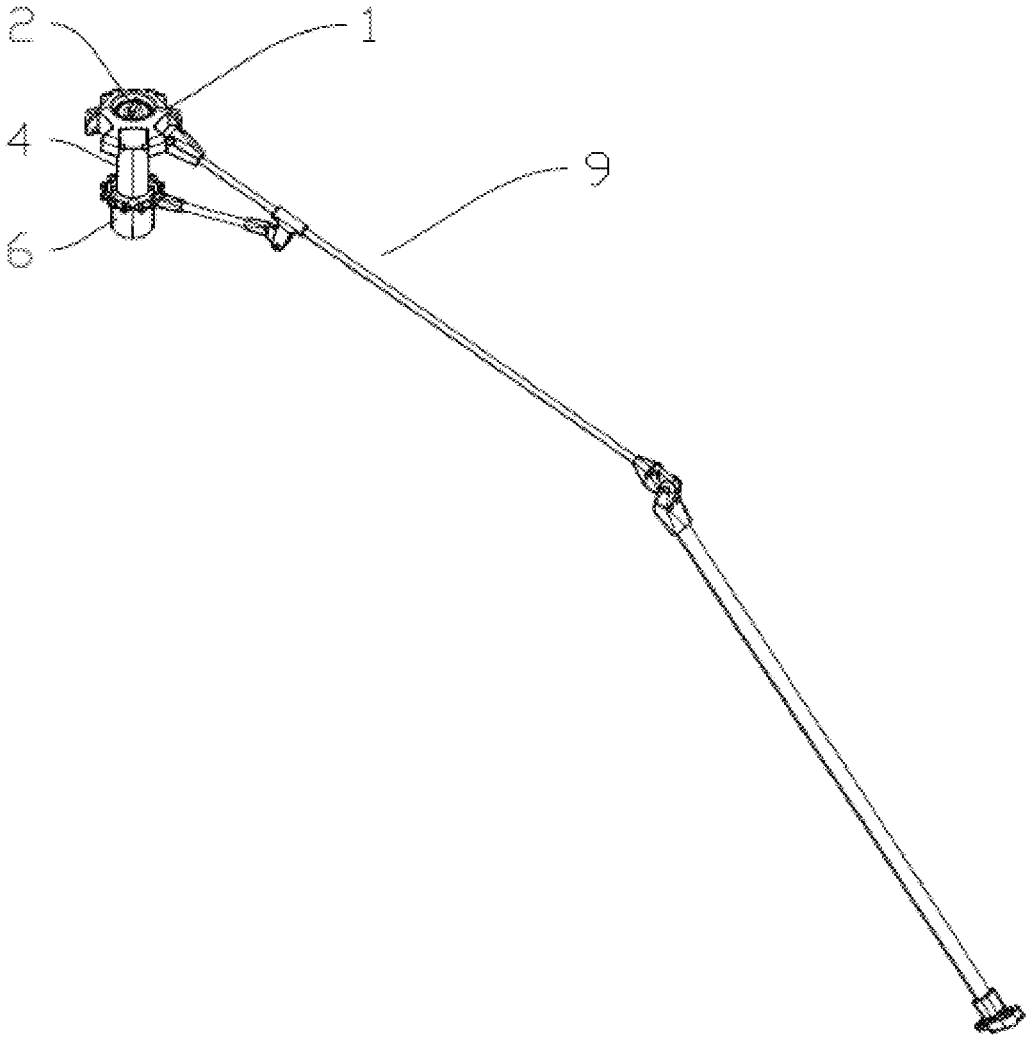
FIG. 1 is a structural diagram of one embodiment of the invention.
Figure 2:
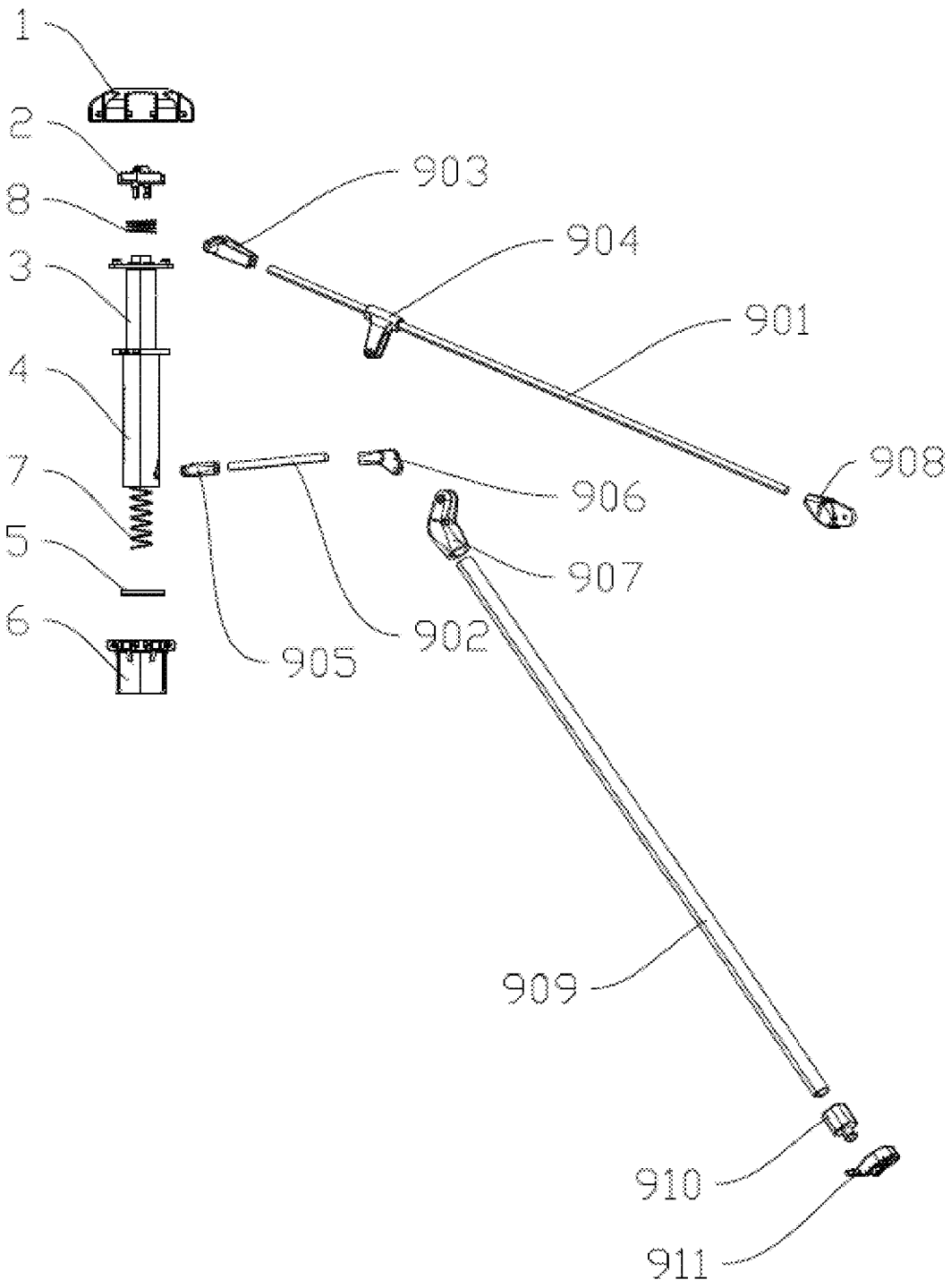
FIG. 2 is an exploded view of one embodiment of the invention.
Figure 3:
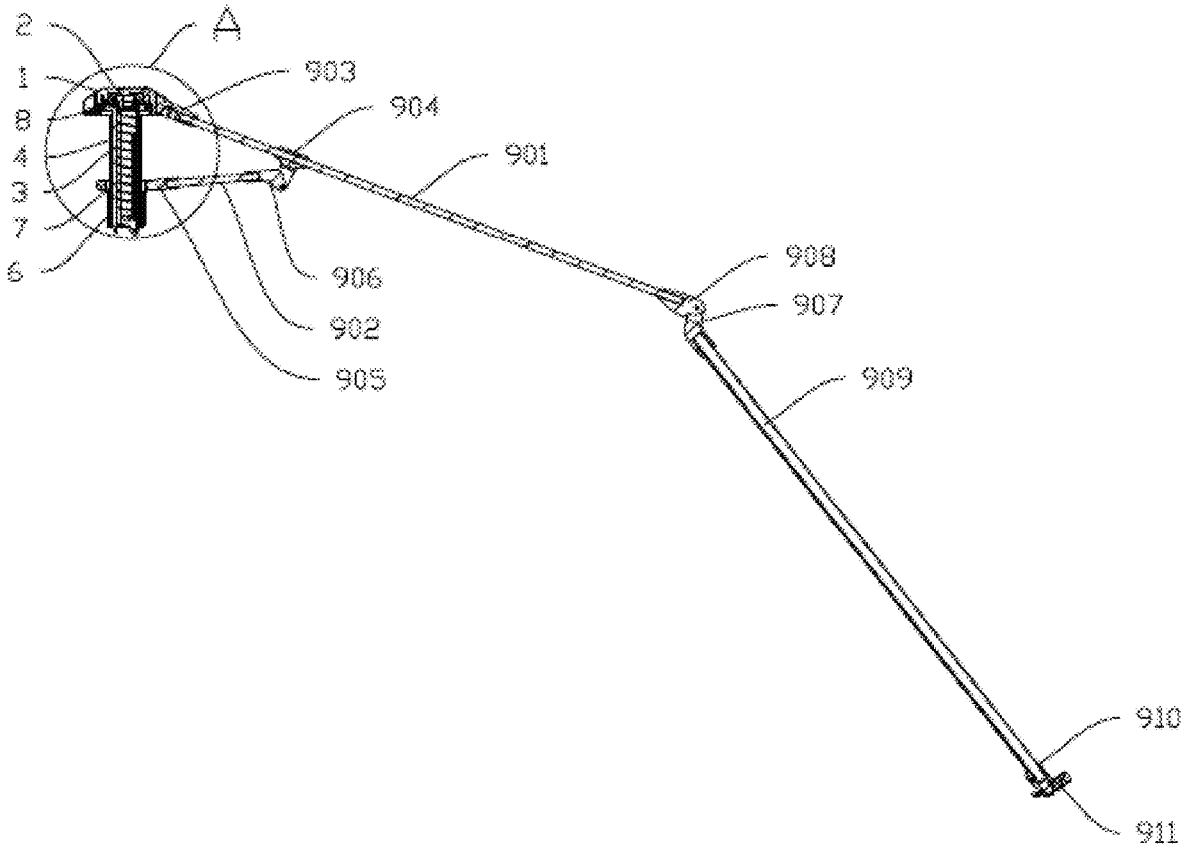
FIG. 3 is a sectional view of one embodiment of the invention.
Figure 4:
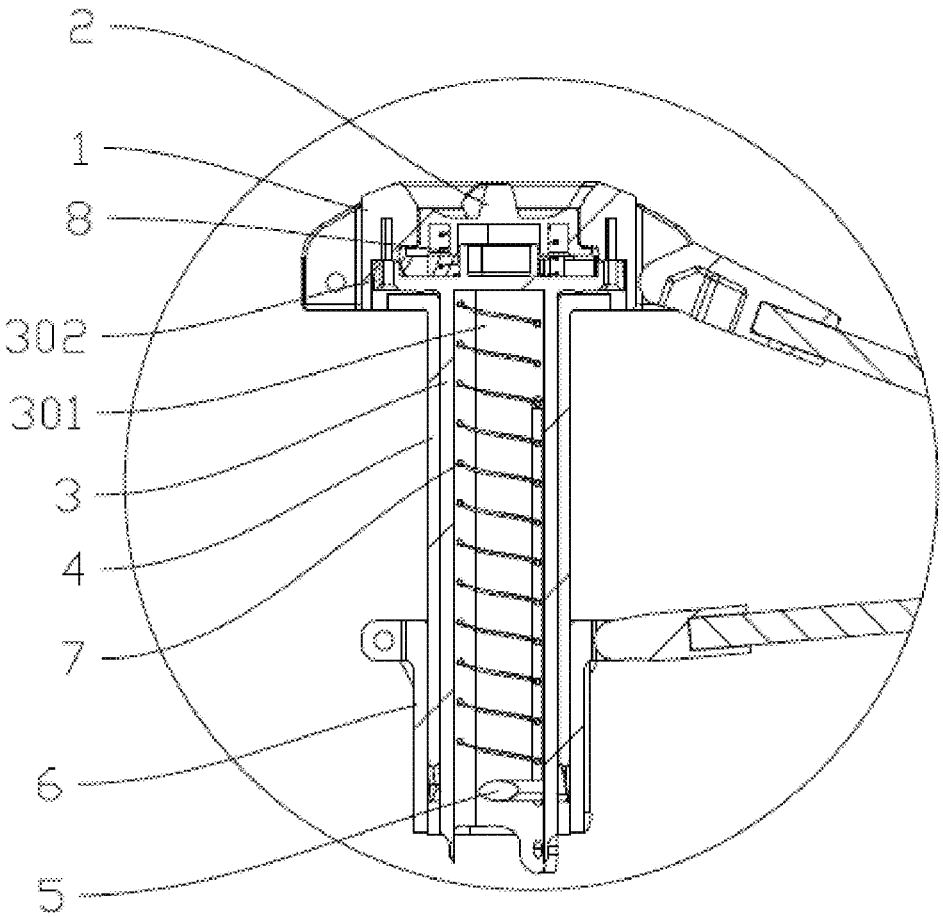
FIG. 4 is an enlarged view of part A in FIG. 3.
Figure 5:
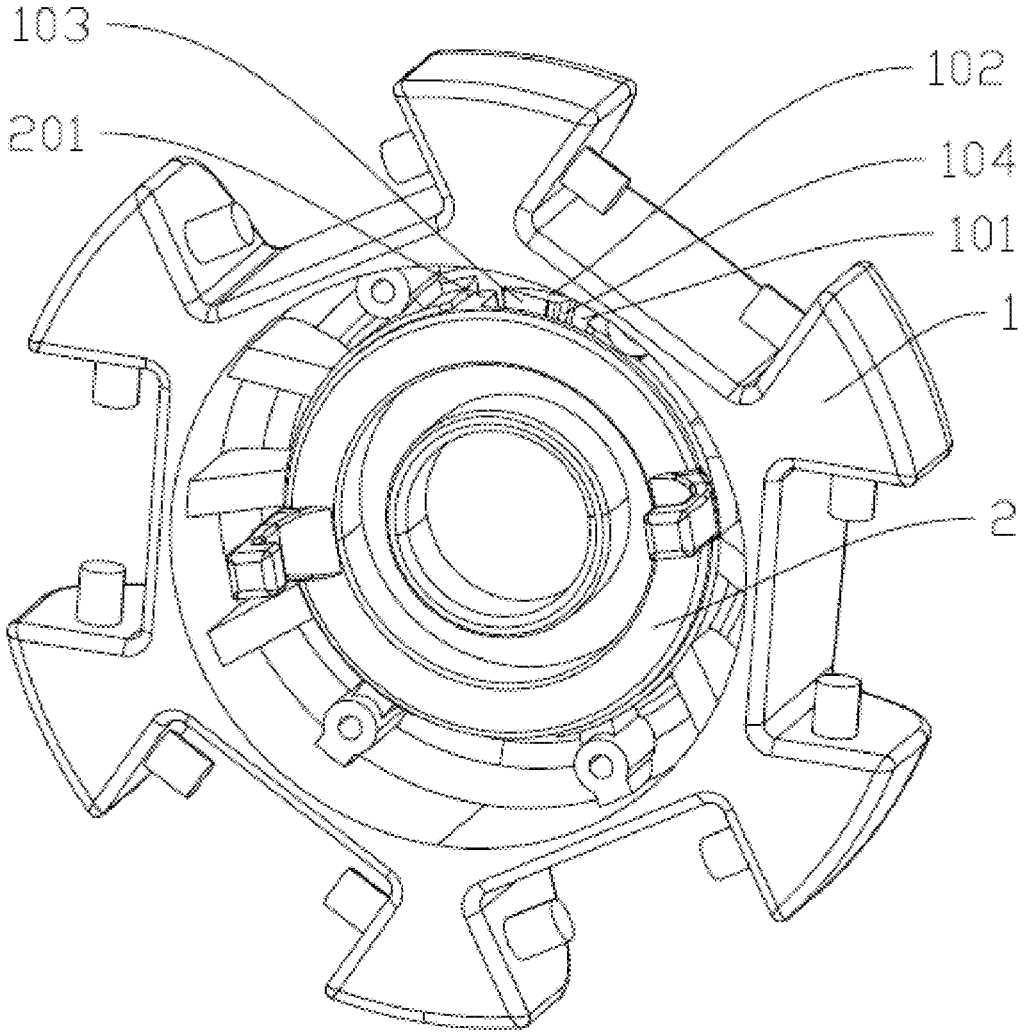
FIG. 5 is a structural diagram of a knob and a top cover matched with the knob according to one embodiment of the invention.
Figure 6:
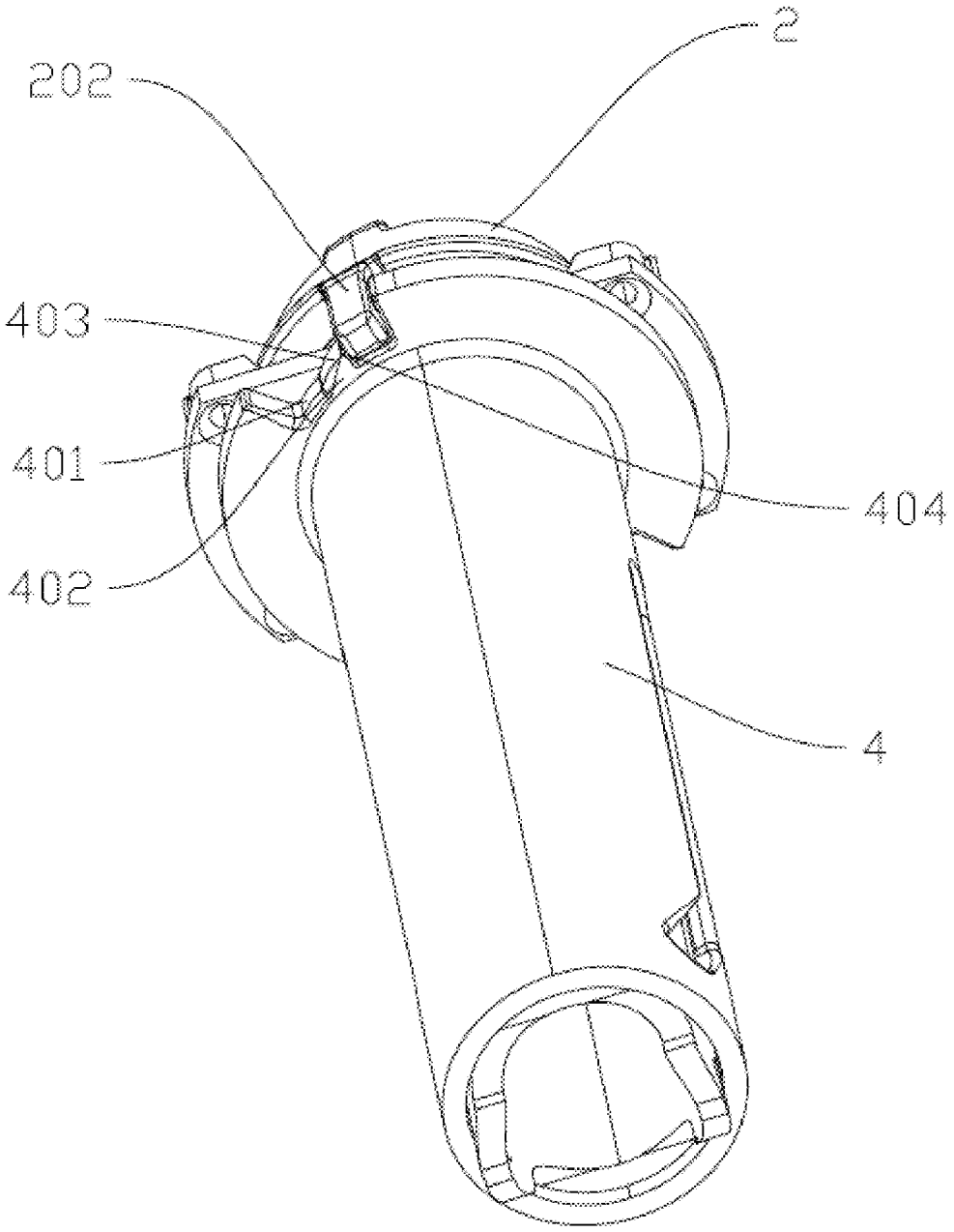
FIG. 6 is a structural diagram of the knob and an outer sliding rod matched with the knob according to one embodiment of the invention.
Figure 7:
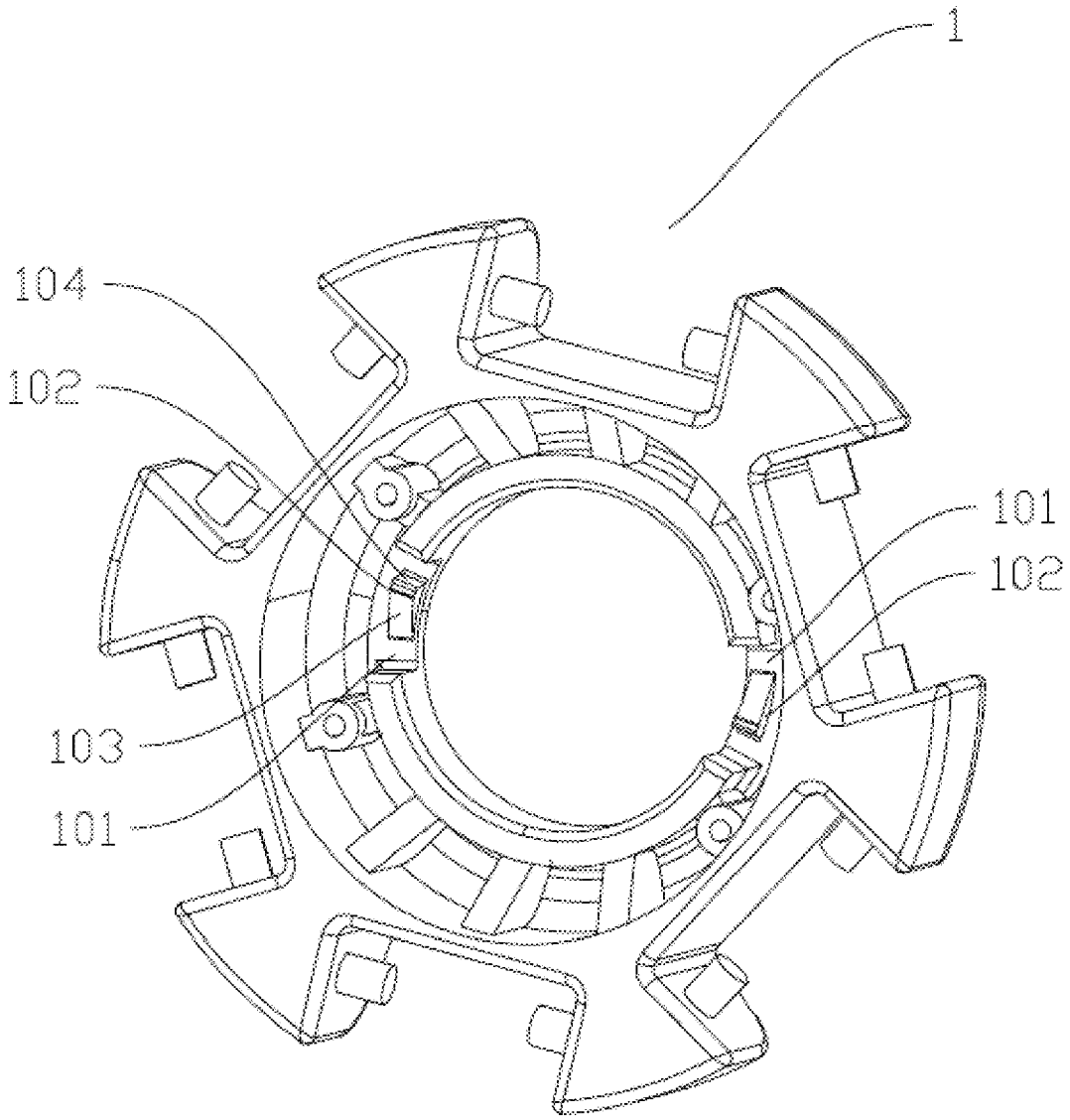
FIG. 7 is a structural diagram of the top cover according to one embodiment of the invention.
Figure 8:
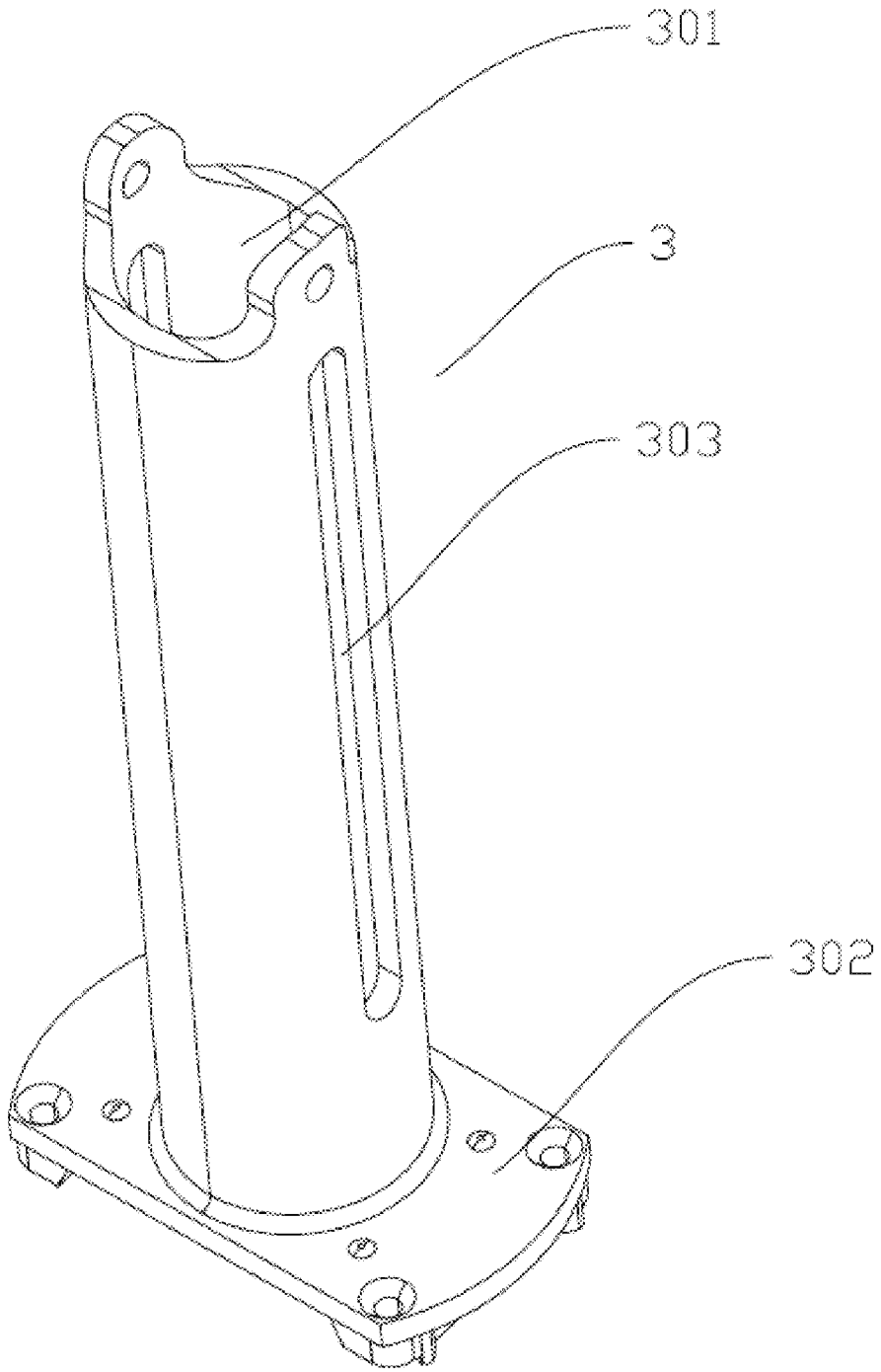
FIG. 8 is a structural diagram of an inner sliding rod according to one embodiment of the invention.
Figure 9:
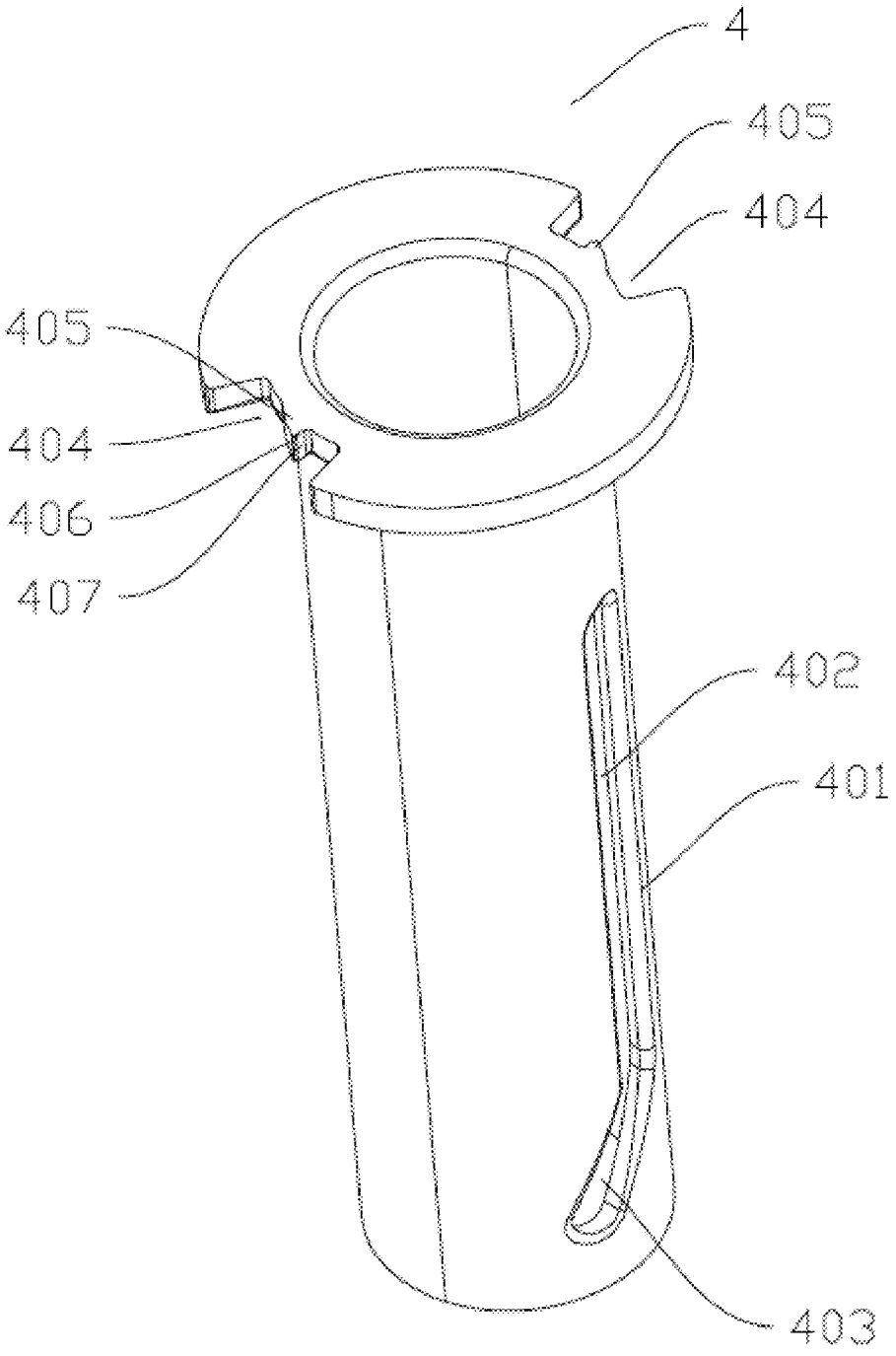
FIG. 9 is a structural diagram of an outer sliding rod according to one embodiment of the invention.
Figure 10:
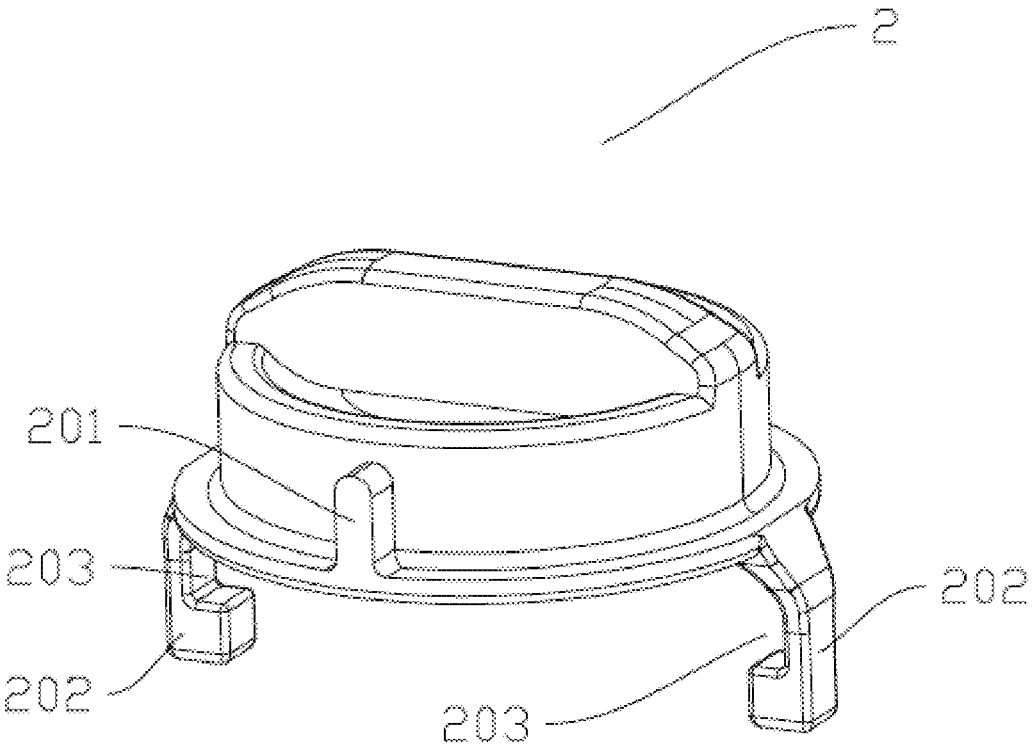
FIG. 10 is a structural diagram of the knob according to one embodiment of the invention.

Referring to FIG. 1-FIG. 10, the invention provides a playpen with an automatic locking function, comprising:

A top cover 1;

An inner sliding rod 3, the inner sliding rod 3 being mounted below the top cover 1 and provided with a cylindrical receiving cavity 301, and first sliding grooves communicated with the cylindrical receiving cavity 301 being formed in two sides of the inner sliding rod 3;

An outer sliding rod 4, the outer sliding rod 4 being rotatably disposed around the inner sliding rod 3, and second sliding grooves 401 being formed in two sides of the outer sliding rod 4 and corresponding to the first sliding grooves in position;

A limiting rod 5, the limiting rod 5 being disposed in the cylindrical receiving cavity 301, and two ends of the limiting rod 5 stretching out along the first sliding grooves and the second sliding grooves 401 and being able to slide in the first sliding grooves and the second sliding grooves 401;

A sliding seat 6, the sliding seat 6 being slidably disposed around the outer sliding rod 4, and the two ends of the limiting rod 5 being clamped with the sliding seat 6;

A knob 2, the knob 2 being mounted in the top cover 1 and clamped with the top cover 1 and the outer sliding rod 4, and the knob 2 being able to move upwards or downwards and rotate with respect to the top cover 1 to be located at a locking position or an unlocking position; and A link assembly 9, the link assembly 9 being articulated with the top cover 1 and the sliding seat 6.

According to the playpen with an automatic locking function in this embodiment, the knob 2 is disposed on the top cover 1 and is clamped with the top cover 1 and the outer sliding rod 4 respectively; when the playpen is unfolded, the limiting rod 5 slides downwards along the first sliding grooves and the second sliding grooves 401 to the bottom, and at this moment, the outer sliding rod 4 drives the knob 2 to rotate from the unlocking position of the top cover 1 to the locking position of the top cover 1, such that the playpen is automatically locked in the unfolded state, which can effectively prevent accidental injuries to users caused by sudden folding of the playpen; the rotary knob 2 can move upwards or downwards and rotate with respect to the top cover 1, and when the playpen is in the unfolded state, the knob 2 can be pressed downwards to rotate to the unlocking position from the locking position, such that the playpen can be freely switched to the locked state or the unlocked state, and the playpen in the unlocked state can be folded by users; and the playpen is simple in structure and convenient to use.

Preferably, the knob 2 is adopted to facilitate user operation, and in actual application, the invention is not limited to the knob, and can adopt, for example, a slide switch, a key or other components capable of fulfilling the same effect as the knob 2 according to the actual condition.

Further, a plurality of mounting sites articulated with the link assembly 9 are disposed on an outer edge of the top cover 1 and an outer edge of the sliding seat 6, and the number of the mounting sites can be set according to the actual condition. In this embodiment, six mounting sites are disposed on the outer edge of the top cover 1 and six mounting sites are disposed on the outer edge of the sliding seat 6, and the six mounting sites are arranged in an array, such that the link assembly 9 can be stressed uniformly, and the stability of the playpen is improved.

Specifically, a first rotary shaft is disposed on the outer sliding rod 4 and the knob 2, and the outer sliding rod 4 and the knob 2 can rotate around the first rotary shaft.

In one embodiment of the invention, each second sliding groove 401 comprises a vertical section 402 and an oblique section 403, and an angle is formed between the vertical section 402 and the oblique section 403, such that the limiting rod 5 can slide along slopes in the oblique sections 403 when moving upwards or downwards; and the oblique sections 403 of the two second sliding rods 401 are opposite in direction, such that the outer sliding rod 4 can rotate in corresponding directions.

In this embodiment, the oblique sections 403 can be matched with the limiting rod 5 to drive the outer sliding rod 4 and the knob 2 to rotate around the first rotary shaft to switch the knob 2 to the unlocking position or the locking position, such that the playpen can be locked automatically when unfolded.

In one embodiment of the invention, first limiting grooves 101 are formed in two sides of the top cover 1, first protrusions 102 are disposed in the middle of the first limiting grooves 101, each first protrusion 102 comprises a first oblique side 103 and a first steep side 104, and limiting protrusions 201 matched with the first protrusions 102 are disposed on two sides of the knob 2; when the limiting protrusions 201 are located the first oblique sides 103, the knob 2 is located at the unlocking position and is in a first state; and when the limiting protrusions 201 are located on the steep sides 104, the knob 2 is located at the locking position and is in a second state.

In this embodiment, when the playpen is unfolded, if the limiting protrusions 201 are located on the first steep sides 104 and clamped with the first protrusions 102, the knob 2 is located at the locking position and is in the second state; and if the limiting protrusions 201 are located on the first oblique sides 103 and movably clamped with the first protrusions 102, the knob 2 is located at the unlocking position and is in the first state.

In one embodiment of the invention, second limiting grooves 404 are formed in two sides of a top end of the outer sliding rod 4, second protrusions 405 are disposed in the middle of the second limiting grooves 404, each second protrusion 405 comprises a second oblique side 406 and a second steep side 407, and two limiting pillars 202 matched with the second protrusions 405 are disposed at the bottom of the knob 2; when the limiting pillars 202 are located on the second oblique sides 406, the knob 2 is movably connected to the outer sliding rod 4; and when the limiting pillars 202 are located on the second steep sides 407, the knob 2 is fixedly connected to the outer sliding rod 4.

In this embodiment, when the playpen is unlocked to be folded, the limiting pillars 202 are located on the second oblique sides 406, and the sliding seat 6 is pushed to slide upwards; when the limiting rod 5 slides upwards along the oblique sections 403 of the second sliding grooves 401 of the outer sliding rod 4, the outer sliding rod 4 rotates around the first rotary shaft, the second protrusions 405 also rotate, and the second oblique sides 406 slide with respect to the limiting pillars 202; and when the limiting rod 5 enters the vertical sections 402 of the second sliding grooves 401, the limiting pillars 202 are located on the second steep sides 407, at this moment, the knob 2 is fixedly connected to the outer sliding rod 4, so the knob 2 is driven to rotate around the first rotary shaft when the outer sliding rod 4 rotates.

In one embodiment of the invention, recesses 203 for receiving the second protrusions 405 are formed in inner sides of the limiting pillars 202. When the second protrusions 405 are received in the recesses 203, the knob 2 can rotate smoothly to be switched to the locking position or the unlocking position freely.

In one embodiment of the invention, a first spring 7 is disposed in the cylindrical receiving cavity 301, one end of the first spring 7 abuts against the bottom of the cylindrical receiving cavity 301, and the other end of the first spring 7 abuts against the limiting rod 5.

In this embodiment, when an external force for keeping the link assembly 9 in the folded state disappears, the first spring 7 in the compressed state will apply a downward force to the limiting rod 5 to drive the limiting rod 5 to move downwards along the first sliding grooves and the second sliding grooves 401; and because the liming rod 5 is fixedly clamped with the fixing seat 6, the sliding seat 6 will be driven to move downwards. By adopting the first spring 7, the playpen can be used conveniently.

In one embodiment, a mounting portion 302 fixedly connected to the top cover 1 is disposed at a top end of the inner sliding rod 3, a second spring 8 is disposed between the knob 2 and the mounting portion 302, and two ends of the second spring 8 abut against the knob 2 and the mounting portion 302 respectively.

In this embodiment, the inner sliding rod 3 is fixedly connected to the top cover 1 through the mounting portion 302, and the two ends of the second spring 8 abut against the knob 2 and the mounting portion 302 respectively; and after being pressed and rotated to be switched to the unlocking position or the locking position, the knob 2 will be released and restore automatically under the action of an upward clastic force of the second spring 8, making the playpen convenient to use.

In one embodiment of the invention, the link assembly 9 comprises an upper support rod 901 and a lower support rod 902, the upper support rod 901 is articulated with the top cover 1 through an upper support rod front connecting sleeve 903, and the lower support rod 902 is articulated with the sliding seat 6 through a lower support rod front connecting sleeve 905.

In one embodiment of the invention, an upper support rod middle connecting sleeve 904 is slidably connected to the middle of the upper support rod 901, an upper support rod rear connecting sleeve 908 is disposed at a rear end of the upper support rod 901, a lower support rod rear connecting sleeve 906 is disposed at an end, away from the sliding seat 6, of the lower support rod 902, and the upper support rod middle connecting sleeve 904 is articulated with the lower support rod rear connecting sleeve 906.

In one embodiment of the invention, the link assembly 9 comprises a vertical rod 909, one end of the vertical rod 909 is articulated with the upper support rod rear connecting sleeve 908 through a vertical rod upper sleeve 907, a vertical rod lower sleeve 910 is disposed at the other end of the vertical rod 909, and a support pad 911 is disposed on the vertical rod lower sleeve 910.

Specifically, a second rotary shaft is disposed at the position where the upper support rod front connecting sleeve 903 is articulated with the top cover 1, such that the upper support rod 901 can rotate around the second rotary shaft with respect to the top cover 1; a third rotary shaft is disposed at the position where the lower support rod rear connecting sleeve 906 is articulated with the upper support rod middle connecting sleeve 904, such that the lower support rod 902 can rotate around the third rotary shaft with respect to the upper support rod 901; and a fourth rotary shaft is disposed at the position where the lower support rod front connecting sleeve 905 is hinged with the sliding seat 6, such that the lower support rod 902 can rotate around the fourth rotary shaft with respect to the sliding seat 6.

The working principle of the playpen with an automatic locking function is as follows:

When the playpen is to be folded, an external force is applied to the upper support rod 901 to enable the upper support rod 901 to swing inwards around the second rotary shaft to be almost vertical, at this same time, an external force is applied to the lower support rod 902 to enable the lower support rod 902 to swing around the third rotary shaft to be close to the upper support rod 901, and the lower support rod 902 swings inwards around the fourth rotary shaft to be almost vertical, such that the upper support rod 901 and the lower support rod 902 are folded. The lower support rod front connecting sleeve 905 drives the sliding seat 6 to an upper portion of the outer sliding rod 4, and the limiting rod 5 fixedly clamped with the sliding seat 6 is driven to upper portions of the sliding grooves of the outer sliding rod 4 and squeezes the first spring 7, such that the first spring 7 is compressed.

When the playpen is in the folded state, the limiting pillars 202 of the knob 2 are located on the first steep sides 104 of the first protrusions 102 of the second limiting grooves 404 of the outer sliding rod 4, and the limiting protrusions 201 of the knob 2 are located on the first oblique sides 103 of the first protrusions 102.

When the playpen is half open, the external force keeping the support frame in the folded state disappears, and the first spring 7 in the compressed state applies a downward force to the limiting rod 5 to enable the limiting rod 5 to move downwards; due to the fact that the limiting rod 5 abuts against the bottom of a rectangular groove in the sliding seat 6, the sliding seat 6 also moves downwards, the lower support rod 902 articulated with the sliding seat 6 is driven to move away from the upper support rod 901 gradually, and the upper support rod 901 swings outwards around the second rotary shaft.

Due to the fact that the limiting rod 5 is inserted into the first sliding grooves and the second sliding grooves 401, the vertical sections 402 of the second sliding grooves 401 of the outer sliding rod 4 are aligned with the first sliding grooves; when the limiting rod 5 slides in the vertical sections 402 of the first sliding grooves, the outer sliding rod 4 will not rotate, the second limiting grooves 404 in the top of the outer sliding rod 4 will not rotate either, and thus, the knob 2 will not rotate. In this state, the knob 2 does not orate, so the limiting protrusions 201 are still located on the first oblique sides 103.

When the playpen is to be locked automatically, the first spring 7 in the compressed state applies a downward force to the limiting rod 5 to enable the limiting rod 5 to continue to move downwards, the sliding seat 6 and the lower support rod 902 also continue to move downwards, and the upper support rod 901 continue to swing outwards around the second rotary shaft.

When the limiting rod 5 slides to the oblique sections 403 of the second sliding grooves 401, the outer sliding rod 4 rotates around the first rotary shaft, the second steep sides 407 abut against the limiting pillars 202, and the outer sliding rod 4 drives the knob 2 to rotate around the first rotary shaft. When the knob 2 rotates around the first rotary shaft, the limiting protrusions 201 are located on the first oblique sides 103 of the first protrusions 102, so the limiting protrusions 201 will slide along slopes of the first oblique sides 103, and in the sliding process, the knob 2 will move downwards and squeeze the second spring 8, such that the second spring 8 is compressed.

When the playpen is completely unfolded and locked automatically, the first spring 7 in the compressed state applies a downward force to the limiting rod 5 to enable the limiting rod 5 to move downwards, the limiting rod 5 stops moving when reaching tail ends of the first sliding grooves of the inner sliding rod 3, at this moment, the limiting rod 5 also slides to the tail ends of the oblique sections 403 of the second sliding grooves 401 of the outer sliding rod 4, at this point, the sliding seat 6 and the lower support rod 902 stop moving downwards, the upper support rod 901 stops swinging outwards, and the support frame is completely unfolded.

When the limiting rod 5 slides to the tail ends of the oblique sections 403 of the second sliding grooves 401, the outer sliding rod 4 rotates around the first rotary shaft by a certain angle and then stops rotating; due to the fact that the second protrusions 405 of the outer sliding rod 4 drive the limiting pillars 202 of the knob 2 to rotate, the knob 2 also rotates around the first rotary shaft and then stops at the same angle.

When the knob 2 rotates around the first rotary shaft, the limiting protrusions 201 of the knob 2 slide along the first oblique sides 103; when the knob 2 stops after rotating by a certain angle, the limiting protrusions 201 of the knob 2 reach the first steep sides 104, and the knob 2 moves upwards under the action of an upward force of the second spring 8 until it returns to the original position.

When the playpen is in the completely unfolded state, the limiting protrusions 201 of the knob 2 reach the first steep sides 104 and abut against the first steep sides, and unless otherwise manually unlocked, the knob 2 will not rotate, the limiting pillars 202 below the knob 2 will not rotate either, at this moment, the second limiting grooves 404 in the top of the outer sliding rod 4 abut against the limiting pillars 202, so the outer sliding rod 4 will not rotate in an opposite direction (a direction opposite to the rotating direction of the outer sliding rod 4 in the process of unfolding the playpen). Because the limiting rod 5 is inserted into the first sliding grooves and the second sliding grooves 401, when the playpen is completely unfolded, the tail ends of the first sliding grooves are aligned with the tail ends of the oblique sections 403 of the second sliding grooves 401, and the limiting rod 5 is located on the vertical sections 402 of the sliding grooves which are aligned, so the outer sliding rod 4 cannot rotate, the limiting rod 5 is fixed at the current position, the sliding seat 6 is also fixed at the current position, and the playpen cannot be folded. In this way, the playpen is automatically folded.

When the playpen is unfolded and locked automatically, users can unlock the playpen as follows:

The knob 2 is pressed and then rotated in an opposite direction (that is, the knob 2 is rotated in a direction opposite to the rotating direction of the knob in the automatic locking process) to the maximum extent, and then the knob 2 is released and will return to the original position under the action of the second spring 8, such that the unlocking operation is completed; movements of internal structures of the knob 2 are as follows: the limiting protrusions 201 of the knob 2 disengage from the first steep sides 104 when the knob 2 is pressed, the limiting pillars 202 below the knob 2 move downwards, and at this moment, the recesses 203 in the inner sides of the limiting pillars 202 are exactly staggered with the second protrusions 405, so the knob 2 can be smoothly rotated in an opposite direction.

When the playpen is unfolded and unlocked, it can be folded as follows:

After the playpen is unfolded, a force is applied to the upper support rod 901 and the lower support rod 902 to enable the upper support rod 901 and the lower support rod 902 to move close to each other, the lower support rod 902 swings upwards around the third rotary shaft to drive the sliding seat 6 to move upwards, and because the bottom of the rectangular groove in the sliding seat 6 abuts against the limiting rod 5, the limiting rod 5 is also driven to move upwards.

When the limiting rod 5 slides on the oblique sections 403 of the second sliding grooves 401, the outer sliding rod 4 rotates in an opposite direction (a direction opposite to the rotating direction of the outer sliding rod in the process of unfolding the playpen), the second limiting grooves 404 also rotate in the opposite direction, the second oblique sides 406 of the second protrusions 405 will slidably abut against the limiting pillars 202 below the knob 2, and because the knob 2 has been locked and cannot rotate in the opposite direction, the limiting pillars 202 of the knob 2 will elastically bend outwards.

Users continue to apply a force to the upper support rod 901 and the lower support rod 902 to enable the upper support rod 901 and the lower support rod 902 to be closer to each other, the sliding seat 6 continues to move upwards, the limiting rod 5 also continues to move upwards, and when the limiting rod 5 slides to the vertical sections 402 of the second sliding grooves 401, the vertical sections 402 of the second sliding grooves 401 will be aligned with the first sliding grooves of the inner sliding rod 3, so the outer sliding rod 4 will not rotate in the opposite direction, and the limiting pillars 202 below the knob 2 are exactly located on the second steep sides 407 of the second protrusions 405.

What is claimed is:

1. A playpen with an automatic locking function, comprising:

A top cover (1);

an inner sliding rod (3), the inner sliding rod (3) being mounted below the top cover (1) and provided with a cylindrical receiving cavity (301), and first sliding grooves communicated with the cylindrical receiving cavity (301) being formed in two sides of the inner sliding rod (3);

an outer sliding rod (4), the outer sliding rod (4) being rotatably disposed around the inner sliding rod (3), and second sliding grooves (401) being formed in two sides of the outer sliding rod (4) and corresponding to the first sliding grooves in position;

a limiting rod (5), the limiting rod (5) being disposed in the cylindrical receiving cavity (301), and two ends of the limiting rod (5) stretching out along the first sliding grooves and the second sliding grooves (401) and being able to slide in the first sliding grooves and the second sliding grooves (401);

a sliding seat (6), the sliding seat (6) being slidably disposed around the outer sliding rod (4), and the two ends of the limiting rod (5) being clamped with the sliding seat (6);

a knob (2), the knob (2) being mounted in the top cover (1) and clamped with the top cover (1) and the outer sliding rod (4), and the knob (2) being able to move upwards or downwards and rotate with respect to the top cover (1) to be located at a locking position or an unlocking position; and a link assembly (9), the link assembly (9) being articulated with the top cover (1) and the sliding seat (6).

2. The playpen with an automatic locking function according to claim 1, wherein each second sliding groove (401) comprises a vertical section (402) and an oblique section (403), and an angle is formed between the vertical section (402) and the oblique section (403), such that the limiting rod (5) can slide along slopes in the oblique sections (403) when moving upwards or downwards; and the oblique sections (403) of the two second sliding rods (401) are opposite in direction, such that the outer sliding rod (4) can rotate in corresponding directions.

3. The playpen with an automatic locking function according to claim 1, wherein first limiting grooves (101) are formed in two sides of the top cover (1), first protrusions (102) are disposed in the middle of the first limiting grooves (101), each first protrusion (102) comprises a first oblique side (103) and a first steep side (104), and limiting protrusions (201) matched with the first protrusions (102) are disposed on two sides of the knob (2); when the limiting protrusions (201) are located the first oblique sides (103), the knob (2) is located at the unlocking position and is in a first state; and when the limiting protrusions (201) are located on the steep sides (104), the knob (2) is located at the locking position and is in a second state.

4. The playpen with an automatic locking function according to claim 1, wherein second limiting grooves (404) are formed in two sides of a top end of the outer sliding rod (4), second protrusions (405) are disposed in the middle of the second limiting grooves (404), each second protrusion (405) comprises a second oblique side (406) and a second steep side 407, and two limiting pillars (202) matched with the second protrusions (405) are disposed at the bottom of the knob (2); when the limiting pillars (202) are located on the second oblique sides (406), the knob (2) is movably connected to the outer sliding rod (4); and when the limiting pillars (202) are located on the second steep sides 407, the knob (2) is fixedly connected to the outer sliding rod (4).

5. The playpen with an automatic locking function according to claim 1, wherein recesses (203) for receiving the second protrusions (405) are formed in inner sides of the limiting pillars (202).

6. The playpen with an automatic locking function according to claim 1, wherein a first spring (7) is disposed in the cylindrical receiving cavity (301), one end of the first spring (7) abuts against the bottom of the cylindrical receiving cavity (301), and the other end of the first spring (7) abuts against the limiting rod (5).

7. The playpen with an automatic locking function according to claim 1, wherein a mounting portion (302) fixedly connected to the top cover (1) is disposed at a top end of the inner sliding rod (3), a second spring 8 is disposed between the knob (2) and the mounting portion (302), and two ends of the second spring 8 abut against the knob (2) and the mounting portion (302) respectively.

8. The playpen with an automatic locking function according to claim 1, wherein the link assembly (9) comprises an upper support rod (901) and a lower support rod (902), the upper support rod (901) is articulated with the top cover (1) through an upper support rod front connecting sleeve (903), and the lower support rod (902) is articulated with the sliding seat (6) through a lower support rod front connecting sleeve (905).

9. The playpen with an automatic locking function according to claim 1, wherein an upper support rod middle connecting sleeve (904) is slidably connected to the middle of the upper support rod (901), an upper support rod rear connecting sleeve (908) is disposed at a rear end of the upper support rod (901), a lower support rod rear connecting sleeve (906) is disposed at an end, away from the sliding seat (6), of the lower support rod (902), and the upper support rod middle connecting sleeve (904) is articulated with the lower support rod rear connecting sleeve (906).

10. The playpen with an automatic locking function according to claim 1, wherein the link assembly (9) comprises a vertical rod (909), one end of the vertical rod (909) is articulated with the upper support rod rear connecting sleeve (908) through a vertical rod upper sleeve (907), a vertical rod lower sleeve (910) is disposed at the other end of the vertical rod (909), and a support pad (911) is disposed on the vertical rod lower sleeve (910).

* * * * *